United States Patent [19]

Wilkie

[11] 4,408,445

[45] * Oct. 11, 1983

[54] TWISTED SINGLES APPAREL YARN

[75] Inventor: Arnold E. Wilkie, Pensacola Beach, Fla.

[73] Assignee: Monsanto Company, St. Louis, Mo.

[ * ] Notice: The portion of the term of this patent subsequent to Sep. 22, 1998 has been disclaimed.

[21] Appl. No.: 301,717

[22] Filed: Sep. 14, 1981

Related U.S. Application Data

[63] Continuation-in-part of Ser. No. 71,460, Aug. 3, 1979, Pat. No. 4,290,378.

[51] Int. Cl.³ ..... D02J 1/08; D02G 3/26

[52] U.S. Cl. ..... 57/246; 57/289; 57/350; 57/351; 57/908; 28/220

[58] Field of Search ..... 57/58.59, 243, 246, 57/247, 282, 289, 290, 350, 351, 908, 206; 28/220, 247, 271–276; 112/410

[56] References Cited

U.S. PATENT DOCUMENTS

| | | | |
|---|---|---|---|
| 2,961,010 | 11/1960 | Berry | 57/206 X |
| 2,985,995 | 5/1961 | Bunting et al. | 57/908 X |
| 3,069,836 | 12/1962 | Dalhstrom et al. | 57/908 X |
| 3,457,610 | 6/1969 | Williams et al. | 57/908 X |
| 3,483,691 | 12/1969 | Williams et al. | 57/908 X |
| 3,537,248 | 11/1970 | Berg et al. | 57/908 X |
| 3,745,617 | 7/1973 | Smith | 28/220 X |
| 3,968,638 | 7/1976 | Norton et al. | 57/247 |
| 4,207,730 | 6/1980 | Lorenz | 57/351 |

*Primary Examiner*—Donald Watkins

*Attorney, Agent, or Firm*—John W. Whisler

[57] ABSTRACT

A bulky, tangled, twisted singles yarn is provided having good bulk and aesthetics. The yarn also has exceptional column strength and resistance of bending and untwisting. The yarn is particularly useful as a sweater yarn or half-hose yarn. The yarn is produced by passing twisted singles yarn having latent bulk through a chamber wherein the yarn is tangled and heated by means of a heated fluid such as superheated steam.

15 Claims, 1 Drawing Figure

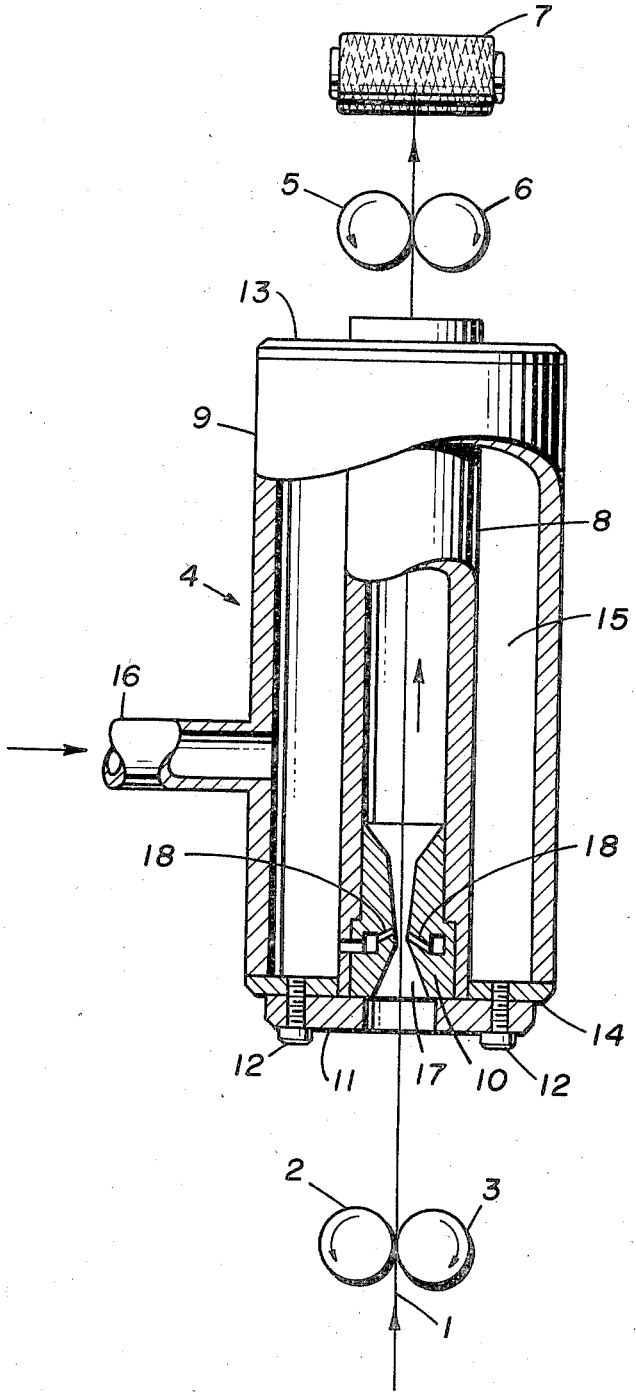
7
5
6
13
9
8
4
15
16
18
18
14
12
11
17
10
12
2
3
1

TWISTED SINGLES APPAREL YARN

CROSS-REFERENCE TO RELATED APPLICATIONS

This application is a continuation-in-part of copending application Ser. No. 71,460, filed Aug. 3, 1979, now U.S. Pat. No. 4,290,378.

BACKGROUND OF THE INVENTION

A. Field of the Invention

This invention relates to novel singles apparel yarns and their production, and is particularly concerned with improved singles yarn for apparel end use applications where previously plied yarns have been used.

B. Description of the Prior Art

In certain apparel end use applications (e.g. sweater and half-hose yarns) plied yarns are used in preference to twisted singles yarns in order to provide a yarn having desirable bulk, aesthetics and stability. Twist renders singles yarns torque-lively, compact (tight) and nonbulky. Also, in the process of imparting twist to a singles yarn the fibers become aligned giving the resulting twisted yarn an undesirable plastic look. It would however be desirable to provide a twisted singles yarn to compete with plied yarns in apparel applications where plied yarns are normally used since singles yarns offer significant economical advantages over plied yarns, for example, elimination of costly plying operations and the economical advantages involved in spinning course counts rather than fine counts.

SUMMARY OF THE INVENTION

According to one aspect of the invention, a tangled yarn is provided, said yarn being a bulky, loopy, tangled, twisted singles apparel yarn and being characterized in having a bundle twist of 2 to 12 turns per inch (78.7 to 472.4 turns per meter), preferably, 4 to 10 turns per inch (157.5 to 393.7 turns per meter) and a lateral coherency of 0.5 to 15 cm, preferably 1 to 8 cm. The tangle disrupts the alignment of the fibers giving the yarn a bulky appearance normally associated with a plied yarn. The yarn of this invention is particularly useful as sweater yarns and half-hose yarns.

The singles yarn of this invention has good dimensionable stability (i.e. is not torque-lively) and has good aesthetics. The yarn has good column strength and resistance to bending and untwisting. The tangle in the yarn locks the twist in the yarn (i.e. imparts "twist-lock" thereto) and significantly reduces the tendency of the yarn to untwist. The tangle in the yarn also serves to cross-brace the filament bundle and enhance its bending resistance and column strength.

According to another aspect of the invention there is provided a novel bulking process for producing the singles yarn of this invention wherein a feed yarn consisting of a yarn having latent bulk to which has been imparted a bundle twist of 2 to 12 turns per inch is continuously fed at an overfeed of 5% to 50% through an open-ended chamber, such as a tube, having at or near its yarn inlet end at least one jet of heated fluid (preferably superheated steam) which impinges laterally against the yarn causing the filaments or fibers on the outside of the twisted bundle to become entangled with filaments on the inside of the twisted bundle through the length of the yarn. Preferably, the yarn in passing through the chamber is under a slight tension sufficient to facilitate handling of the yarn. The tension is easily controlled by adjusting the velocity of the jet of heated fluid and/or overfeed. The entangled filaments serve structurally to cross-brace the yarn, in that, the resulting entanglements tend to traverse the long axis of the yarn. In passing through the chamber the yarn is in intimate contact with high velocity heated fluid for a period of time sufficient to achieve desired bulking of the yarn. The turbulence of the yarn caused by the action of the high velocity fluid enhances bulking, particularly, bulking of acrylic yarns. The turbulence causes isolation of the individual fibers or filaments, thereby leaving the fibers or filaments free (i.e. unrestricted) to shrink and bulk. Turbulent action of the yarn is often referred to a "working" the yarn and is commonly accomplished by tumbling. The chamber passage is filled with and may also be jacketed with heated fluid. Normally, surface loops are created by the jet action. These loops contribute to the overall aesthetics and bulk of the yarn.

BRIEF DESCRIPTION OF THE DRAWING

The FIGURE is a schematic of an apparatus arrangement suitable for use in preparing the singles yarn of this invention.

DETAILED DESCRIPTION OF THE INVENTION

Latent bulk may be imparted to the feed yarn by any suitable means such as by processes described and/or employed in the texturing art such as by hot-jet crimping, stuffer-box crimping, gear-crimping, etc. or by use of appropriate bicomponent filaments or by spinning techniques. Twist is then imparted to the yarn and may be accomplished using conventional twisting equipment such as a cabler or ring twister.

The apparel feed yarn having latent bulk may be composed of either staple fibers or continuous filaments of polymeric materials such as polyamides, polyesters, polyolefins, and acrylics with acrylics being particularly suitable. The term "acrylic" as used herein means any long chain synthetic polymer composed of at least 35% by weight and, preferably, at least 85% by weight of acrylonitrile units $$(-CH_2-\underset{\underset{CN}{|}}{CH}-)$$

in the polymer chain and includes copolymers of acrylonitrile and one or more suitable monoethylenically unsaturated monomers copolymerizable with acrylonitrile, such as, vinyl acetate, methylmethacrylate, methacrylate, styrene, vinyl chloride, vinylidene chloride, sulfonated comonomers, vinyl bromide and the like. Examples of polymeric materials include nylon 6, nylon 66, polyethylene terephthalate and copolymer of acrylonitrile and vinyl acetate (94%/6%). Normally, a continuous filament feed yarn will have a total denier of less than 1200 and a staple yarn will have a cotton count (cc) of greater than about 4.4 (5315/cc=denier) with a denier per filament or fiber (dpf) between 1 and 20. Of course, the feed yarn may be of a higher denier or lower cotton count or dpf, if desired.

Acrylic singles yarns of the invention are particular useful for sweater and half-hose yarns which use is presently being served by plied acrylic yarns.

According to still another aspect of the invention, there is provided a continuous process for in-line twisting and bulking of singles feed yarn of the type described hereinbefore. The small geometry of the tangling/bulking apparatus and the continuous nature of the process permit the apparatus to be coupled in-line with twisting equipment and/or other processing equipment.

In a preferred embodiment of the invention disclosed in the FIGURE, feed yarn 1, having twist and latent bulk, is fed from a suitable source (not shown) between driven roll 2 and its associated idler cot roll 3, through device 4, between driven roll 5 and its associated idler cot roll 6 and, finally wound on to a take-up roll to form package 7. Roll 2 is driven at a higher peripheral speed than roll 5 so as to provide a 5% to 50% overfeed.

Device 4 comprises an inner tubular member 8, an outer tubular member 9 and a replaceable jet nozzle 10 sealably positioned within member 8 at the yarn inlet end of device 4 by means of follower ring 11 held by cap screws 12. Members 8 and 9 are connected at the yarn inlet end and yarn outlet and by shoulders 14 and 13, respectively, thereby defining annular space 15 which jackets tubular member 8. Superheated steam under pressure is supplied to annual space 15 via conduit 16. Jet nozzle 10 has a bore 17 through which yarn 1 passes and which has three sections, a converging frusto-conical inlet section, a diverging frusto-conical outlet section, and a diverging frusto-conical middle section that joins said inlet and outlet sections. Preferably, at least two ports 18 are spaced apart along the axis of the jet nozzle and spaced circumferentially about the axis connect space 15 and middle bore section. Each port 18 and the middle bore section define an acute angle. Normally, this angle will be between 50° and 80°.

Yarn 1 passes through device 4 via follower ring 11, bore 17 and, finally, into and through member 8. Superheated steam passes from space 15 through ports 18 and impinges laterally against yarn 1 within bore 17 at an angle sufficient to forward the yarn into device 4 and at a velocity sufficient to achieve a desired level of tangle. During processing of the yarn bore 17 is filled with steam and tubular member 8 is filled with and jacketed by steam, thereby providing within tubular member 8 an environment in which the twist is capable of being set in the yarn and latent bulk developed. For a given set of processing conditions (e.g. steam, pressure and temperature, yarn speed, denier of yarn, etc.) tubular member 8 must be of a length sufficient to allow adequate time for significant bulking to occur. Normally, with yarn inlet speeds of up to 100 mpm a tubular member length between 10 and 50 cm is more than sufficient to allow adequate time to develop the bulk in the yarn. It has been found that making tubular member 8 longer than necessary has little effect. Of course, speeds in excess of 100 mpm may suitably be used by selecting appropriate processing conditions.

Processing conditions or factors which have some influence on the tangle level imparted to the yarn are: velocity at which the jet of steam impinges against the yarn, temperature of the steam, yarn speed, total denier and denier per filament of the yarn, composition of the yarn, bulk of the yarn, shrinkage of the yarn, finish applied to the yarn and overfeed. Normally, except for the velocity of the steam and overfeed, the other conditions or factors are fixed for a given process. In general, it is desirable to operate the process at an overfeed which is as high as practical, that is, as high as possible while still maintaining continuous and smooth processing of the yarn. The tangle level can then be adjusted by adjusting the steam pressure which in turn changes the velocity of the steam. Several adjustments of the overfeed and steam velocity may be required to attain the desired tangle level and highest practical overfeed. While it is preferred to use superheated steam as the heated fluid, heated air or some other heated fluid such as heated nitrogen or carbon dioxide could possibly be used.

It will be appreciated that, if desired, the entire embodiment shown in the FIGURE could be inverted so that the yarn would be traveling in a downward instead of upward direction.

Devices particularly useful in carrying out the jet-set process of this invention are described in U.S. Pat. Nos. 3,457,610 and 3,745,617. The jet nozzles described in these patents may be replaced with other suitable nozzles. A particularly preferred nozzle for use with the invention is that described in U.S. Pat. No. 3,609,834. Accordingly, the disclosures of the three above-mentioned patents are incorporated herein by reference.

(a) Lateral Coherency

The term "lateral coherency" as used herein is determined by the following test: A 20-inch (50.8 cm) sample of yarn, if twisted, is manually untwisted. Then, the sample is horizontally positioned between two clamps, one fixed and the other free to move toward the fixed clamp. The yarn is under a slight tension (about 1 gram) to remove slack. Two hooks, each weighing approximately one gram, are then placed equidistant from the clamps and in about the center of the yarn bundle to separate the bundle into two equal groups of fibers or filaments. One hook is fixed and a 14-gram weight is attached to the other hook. When the weight is attached to the hook, the two groups of fibers or filaments are pulled apart. As the hook with the 14-gram weight moves away from the fixed hook, the movable clamp moves toward the fixed clamp in the horizontal direction. When the weight comes to rest, the distance between the hooks in centimeters is measured. The average of twelve determinations is taken as the lateral coherency. If the yarn is completely pulled apart by the test the lateral coherency is infinity ($\infty$). The smaller the lateral coherency valve, the more coherent the yarn.

(b) Threadline Diameter

The diameter of a given yarn is measured on a sample having a length of 50.8 cm (20 inches). The diameter is measured at 2.54 cm (1 inch) intervals along the length of the sample using a micrometer. The 20 values obtained are averaged to obtain the "Threadline Diameter." The difference in threadline diameter of a given yarn before ($d^1$) and after ($d^2$) heat treatment, expressed as a percentage ($d^2-d^1/d^1\times 100$), is an indication of bulk developed by the treatment.

(c) Boiling Water Shrinkage

Boiling water shrinkage is measured on a skein of yarn. The skein is prepared by making 10 revolutions of the yarn on a denier creel having a diameter of 22.1 inches (56.1 cm). The skein is vertically suspended between two hooks, a stationary top hook over which the skein is hung and a lower hook which is hooked through the skein. A 180-gram weight is attached to the lower weight and the distance ($d^1$) between the two hooks is measured. The skein is then removed from the hooks, immersed in boiling water for 10 minutes and air dried. The skein is then again vertically suspended between the two hooks with the 180-gram weight attached to the lower hook and the distance ($d^2$) between the two hooks is measured. Percent boiling water shrinkage (% BWS) is calculated from the expression % BWS$=(d^1-d^2/d^1\times 100$.

The following example is given to further illustrate the invention. In the example an apparatus arrangement substantially as shown in the FIGURE was used. Device 4 had an outer tubular member 9 comprised of standard 2.5 inch (6.3 cm) pipe and an inner tubular member 8 comprised of standard 1.5 inch (3.8 cm) pipe having an inside diameter of 0.75 inches (1.9 cm). Member 8 projected 0.5 inch (1.27 cm) beyond the outlet end of member 9. The overall outside diameter of jet nozzle 10 was 0.75 inch and the overall length was 1.327 inch (3.37 cm). The nozzle contained 3 removable waffers as shown in FIG. 5 of U.S. Pat. No. 3,609,834. The coverging inlet section of the nozzle bore had a 50° cone angle and converged to a bore diameter of 0.078 inch (2 mm). The middle bore section then diverged at a 15° cone angle and joined the diverging outlet having a 90° cone angle. The center waffer had one slot and the top waffer two slots (conduits) each drilled through the wall of the bore at an angle of 140° with respect to the axis of the bore. The slots in the top waffer were spaced 0.050 inch (1.3 mm) on center and the slot in the center waffer was spaced opposite and equidistant from the slots in the top waffer. The slots in the top waffer each had a depth of 0.040 inch (1.02 mm) and a width of 0.012 inch (0.30 mm). The slot in the center waffer had a depth of 0.030 inch (0.76 mm) and a width of 0.020 inch (0.51 mm). The nozzle was locked into the body assembly as shown in the FIGURE.

The device was mounted about 12 inches (30.48 cm) from a driven feed roll-cot roll combination on a vertical frame. A similar roll combination was located about 10 inches (25.4 cm) above the device and a winder was located below this roll combination. The coupling of the device was connected to a supply of superheated steam by means of pipe with a pressure gauge and steam pressure regulator immediately upstream. The device was thermally insulated with standard-thickness magnesia pipe covering and wrapped with seamed asbestos cloth. The follower ring was left uninsulated and exposed so that the jet nozzle could be easily removed and replaced. Two funnel-mouthed aluminum ducts, one below and one above the device, were each connected to a vacuum source to draw away fumes from the operating area.

EXAMPLE

A feed yarn composed of acrylic staple fibers each having a denier of 6 and a cut length of 6 inches (15.2 cm) was treated (tangled and bulked) in accordance with the invention using the apparatus shown in the FIGURE. The yarn was of a 5½ cotton count size and contained 4 turns of twist per inch (157.5 turns per meter). The fibers were made from a copolymer consisting of about 94% by weight acrylonitrile and 6% by weight vinyl acetate. The apparatus was operated using superheated steam as the heated fluid under the following conditions:

| | |
|---|---|
| Lower feed roll speed (ypm/mpm) | 79/72.2 |

-continued

| | |
|---|---|
| Upper feed roll speed (ypm/mpm) | 65/59.4 |
| Overfeed (%) | 17 |
| Superheated steam pressure (psig/newton per $m^2$) | $25/2.0\times 10^5$ |
| Superheated steam temperature (°C.) | 235 |

The resulting yarn was bulky and had very pleasing aesthetics. The yarn also had good lateral coherency and resisted untwisting and bending. Properties of the treated yarn and feed yarn were determined and are given below:

| Yarn Property | Treated Yarn | Feed Yarn |
|---|---|---|
| Threadline diameter (cm) | 0.09 | 0.06 |
| Lateral Coherency (cm) | 3.4 | ∞ |
| BWS (%) | 6.8 | 9.5 |
| Breaking Strength (g) | 542 | 494 |
| Elongation-to-break (%) | 18.9 | 13.9 |
| Tenacity (grams per denier) | 0.82 | 0.77 |

The above data show the treated yarn to have a bulk 50% greater than the feed yarn and greater tensile strength. The tensile properties were measured on an Instron Tester (Instron Engineering Corporation, Canton, Mass.) providing a constant rate of extension of 120% per minute with a gauge length of 25 cm being used.

Similar results will also be obtained when a corresponding nylon or polyester feed yarn is substituted for the acrylic yarn or a yarn of a different cotton count or denier.

I claim:

1. A tangled yarn, said yarn being a bulky, loopy twisted apparel singles yarn and being characterized in having a bundle twist of 2 to 15 turns per inch and a lateral coherency of 0.5 to 15 cm.

2. The yarn of claim 1 wherein the lateral coherency is between 1 and 8 cm.

3. The yarn of claim 1 wherein the bundle twist is at least 4 turns per inch.

4. The yarn of claim 1 wherein the yarn is composed of continuous filaments.

5. The yarn of claim 4 wherein the yarn has a denier of less than about 1200.

6. The yarn of claim 1 wherein the yarn is composed of staple length fibers.

7. The yarn of claim 6 wherein the yarn has a cotton count greater than about 4.4.

8. The yarn of claim 1 wherein the yarn is an acrylic yarn.

9. The process for bulking a twisted singles apparel yarn having latent bulk and a bundle twist of 2 to 12 turns per inch, comprising: passing said singles twisted yarn at an overfeed of from 5 to 50% through an open-ended tubular chamber filled with a heat fluid, wherein at the yarn inlet of said chamber at least one jet of heated fluid is directed laterally against the yarn at a velocity sufficient to cause filaments or fibers at the outside of the bundle to entangle with those at the inside of the bundle along the entire length of the yarn and wherein the temperature of the heated fluid and the residence time of the yarn in the chamber are correlated to bulk the yarn and the overfeed and velocity of said heated fluid are correlated to provide a yarn having a lateral coherency of 0.5 to 15 cm.

10. The process of claim 9 wherein the lateral coherency is between 1 and 8 cm.

11. The process of claim 9 wherein the heated fluid is superheated steam.

12. The process of claim 11 wherein the yarn has a bundle twist of at least 4 turns per inch.

13. The process of claim 11 wherein the yarn is a continuous filament yarn.

14. The process of claim 11 wherein the yarn is composed of staple length fibers.

15. The process of claim 10 wherein the yarn is an acrylic yarn.

* * * * *